United States Patent [19]

Medovar et al.

[11] 3,999,595

[45] Dec. 28, 1976

[54] APPARATUS FOR MELTING HOLLOW METAL INGOTS DURING ELECTROSLAG REMELTING OF CONSUMABLE ELECTRODES

[76] Inventors: Boris Izrailevich Medovar, ulitsa A. Barbjusa, 22/26, kv. 109; Ilya Iosifovich Kumysh, ulitsa Prazhskaya 3, kv. 441; Georgy Alexandrovich Boiko, ulitsa v1. Lybedskaya, 16, kv. 106; Stanislav Vitalievich Grodzitsky, ulitsa Matejuka, 5, kv. 190, all of Kiev; Nikolai Vasilievich Arkhipov, ulitsa Moskovskaya, 3, kv. 85; Anatoly Nikolaevich Skoropupov, ulitsa Moskovskaya, 3, kv. 80, both of Petrozavodsky, all of U.S.S.R.

[22] Filed: July 8, 1975

[21] Appl. No.: 593,945

[52] U.S. Cl. ..... 164/252; 164/52; 164/85; 164/274

[51] Int. Cl.[2] ..... B22D 27/02

[58] Field of Search ..... 164/252, 52, 85, 274

[56] References Cited

UNITED STATES PATENTS

| | | | |
|---|---|---|---|
| 3,610,320 | 10/1971 | Medovar et al. | 164/252 |
| 3,721,286 | 3/1973 | Paton et al. | 164/52 |
| 3,768,541 | 10/1973 | Paton et al. | 164/52 |
| 3,834,443 | 9/1974 | Ujlle | 164/252 X |

*Primary Examiner*—Leonidas Vlachos
*Attorney, Agent, or Firm*—Holman & Stern

[57] ABSTRACT

An apparatus for melting hollow metal ingots during electroslag remelting of consumable electrodes has a hollow chilled mould and a mandrel for moulding the cavity of an ingot which are mounted on a bottom plate at the beginning of the ingot melting cycle. The bottom plate has at least two projections on the working surface thereof. Each projection is shaped as a tooth of a thickness equal to the amount of space between the surface of the inner wall of the chilled mould and the outer surface of the mandrel which moulds the ingot, and the height and the width of each projection are commensurable with the thickness thereof. The projections may be replaceable and may have a trapezoidal cross section. The provision of the projections on the bottom plate prevents the mandrel from being jammed with the ingot being moulded at the beginning of the melting process.

4 Claims, 5 Drawing Figures

APPARATUS FOR MELTING HOLLOW METAL INGOTS DURING ELECTROSLAG REMELTING OF CONSUMABLE ELECTRODES

BACKGROUND OF THE INVENTION

The present invention relates to apparatus for melting hollow metal ingots during electroslag remelting of consumable electrodes and may be used in melting pipes of round, square, rectangular and the like cross-sectional shapes.

At present it is known to use for melting hollow metal ingots by electroslag remelting of consumable electrodes an aparatus comprising a hollow chilled mould, a mandrel introduced into the internal space of the chilled mould to define the cavity of the ingot being melted, and a bottom plate comprising a chilled plate. The hollow chilled mould is mounted with its end face on the flat surface of the bottom plate prior to the beginning of the ingot melting cycle so that the bottom plate serves as a bottom wall of the mould.

It should be, however, noted that during the melting of a hollow metal ingot involving the relative displacement of the ingot and the chilled mould at the beginning of the melting cycle where the hollow chilled mould is on the bottom plate, the mandrel is jammed with the solidifying metal of the hollow ingot. This is due to the fact that the first portions of molten metal are intensively solidified upon hitting against the cold bottom plate so that they jam the mandrel as a result of shrinkage.

In order to prevent the mandrel from being jammed with the ingot during the shrinkage thereof, the mandrel or the bottom plate is displaced relative to the chilled mould.

However, in view of the difficulties encountered in selecting a desired speed of movement of the hollow chilled mould, the bottom plate or the mandrel, it is not possible to eliminate the jamming of the mandrel with the hollow ingot being moulded in all cases. At low speeds of movement of the hollow mould or the mandrel, the jamming of the mandrel with the ingot being moulded may occur, whereas at high speeds thereof molten metal may penetrate through the space between the lower end face of the chilled mould and the bottom plate.

As a result of experiments and studies, the inventors have come to the conclusion that it is highly desirable to start the melting process for obtaining a hollow metal ingot with the hollow chilled mould and the mandrel in a fixed position relative to the bottom plate or at a very low speed of their relative movement. In this case a reliable cohesion between the hollow ingot being moulded and the bottom plate is ensured, and the solidification of molten metal which thus occurs complies with requirements imposed in conformity with the production technique for ingot melting, while the penetration of molten metal through the space between the lower end face of the chilled mould and the bottom plate is completely eliminated. The jamming of the mandrel with the hollow ingot being moulded represents, however, an important problem associated so far with the process of melting hollow ingots.

SUMMARY OF THE INVENTION

It is an object of the present invention to provide an apparatus for melting hollow metal ingots during electroslag remelting of consumable electrodes which eliminates the jamming of the mandrel with the hollow metal ingot being formed at the beginning of the melting thereof, where the bottom plate remains stationary relative to the hollow chilled mould and the mandrel or is slowly displaced relative thereto.

This object is accomplished by the provision of an apparatus for melting hollow metal ingots during electroslag remelting of consumable electrodes comprising a hollow chilled mould mounted on a bottom plate and a mandrel for moulding the cavity of the ingot being formed introduced into the internal space of the chilled mould, wherein, according to the invention, the bottom plate is provided with at least two projections on the working surface thereof made in the form of teeth, the thickness of each tooth being equal to the amount of space between the inner surface of the hollow chilled mould and the outer surface of the mandrel which moulds the ingot, while the height and the width of each projection being commensurable with the thickness thereof.

The provision of the projections on the working surface of the bottom plate eliminates jamming of the mandrel with the hollow metal ingot being formed.

This is achieved due to the fact that the projections on the working surface of the bottom plate divide the lower part of the hollow metal ingot being formed into portions whose number is equal to the number of the projections on the working surface of the bottom plate. Thus, the shrinkage of each of the lower end portions of the ingot occurs in the direction towards the geometrical center of that portion, rather than in the direction of the geometrical center of the hollow metal ingot being formed.

Thereafter, the jamming of the mandrel by the metal ingot being formed is eliminated during the time period of remelting of the hollow metal ingot at a height equal to the height of the projection on the working surface of the bottom plate, since as the ingot is moulded, the cooling effect of the bottom plate is materially reduced. As the molten metal bath reaches the upper (end) portions of the projections, the displacement of the bottom plate or the hollow chilled mould and the mandrel begins, and then the ingot is formed by the known method.

The projections of the bottom plate in this apparatus may be of a trapezoidal shape in a longitudinal section with the larger side of the trapezium facing the bottom plate.

This shape of the projections facilitates the removal of the metal ingot formed from the bottom plate.

The bottom plate of the apparatus is preferably provided with grooves for mounting and fixing replaceable projections in these grooves.

As the projections operate under the most severe conditions and, hence, they are prone to a rapid wear, the provision of such fixing method permits readily replacement of them without replacing the entire bottom plate.

Where the bottom plate of the apparatus is of rectangular shape, the projections are preferably arranged thereon symmetrically relative to the longitudinal and transverse axes of the bottom plate.

This ensures the symmetrical distribution of internal stresses in the bottom part of the ingot during the solidification of the hollow metal ingot and simplifies the construction of the bottom plate.

BRIEF DESCRIPTION OF THE DRAWINGS

The invention will now be described in detail with reference to specific embodiments thereof illustrated in the accompanying drawings, in which.

DETAILED DESCRIPTION OF PREFERRED EMBODIMENT

Figure 1:
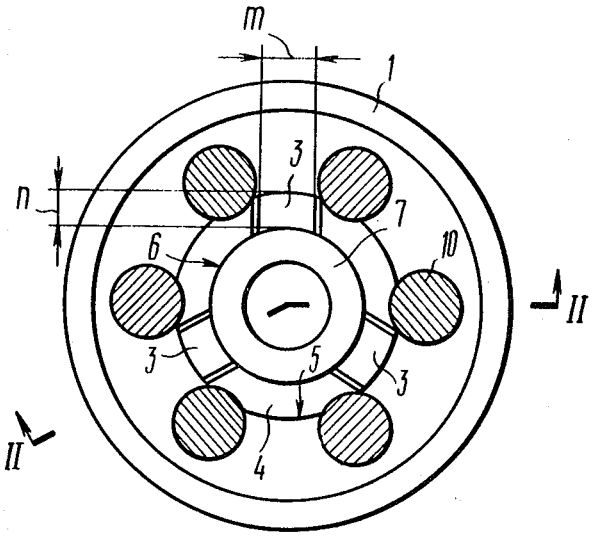
FIG. 1 shows a plan view of the apparatus according to the invention with a hollow chilled mould, a mandrel and a bottom plate of round cross-sectional shape.
Figure 2:
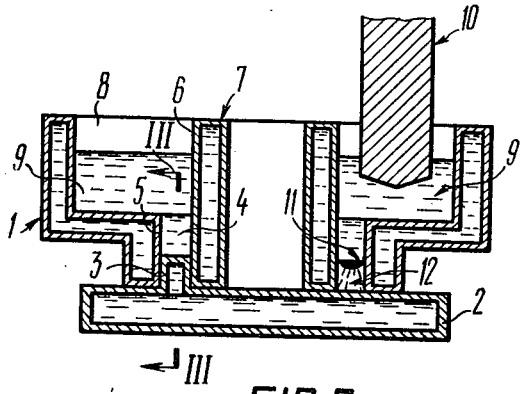
FIG. 2 is a sectional view taken along the line II — II in FIG. 1.

The apparatus according to the invention comprises a hollow chilled mould 1 (FIG. 1) mounted on a bottom plate 2 (FIG. 2) having projections 3 received in a space defined between the surface of an inner wall 5 of the hollow chilled mould 1 and the surface of an outer wall 6 of a mandrel 7 which is introduced into the hollow chilled mould 1 to define the cavity of a hollow metal ingot being formed.

Figure 3:
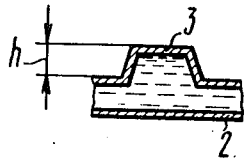
FIG. 3 is a sectional view taken along the line III — III in FIG. 2 (only one projection integral with the bottom plate is conventionally shown)

The projections 3 (FIG. 3) may be of trapezoidal shape in longitudinal section, the larger side of the trapezium facing the bottom plate 2, and the smaller side being at the top.

The hollow chilled mould 1 (FIG. 2) has an enlarged top part 8 for forming and maintaining a slag bath 9 and for melting therein consumable electrodes 10.

Figure 4:
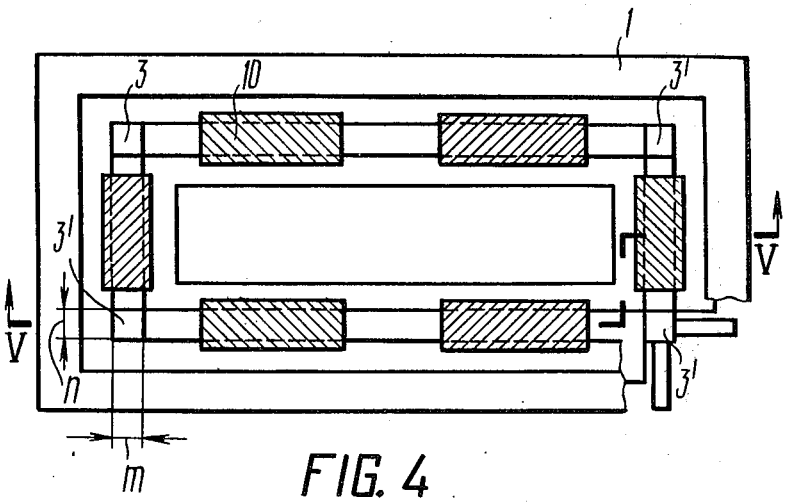
FIG. 4 shows consumable electrodes in section and the apparatus according to the invention having a hollow chilled mould, a mandrel and a bottom plate with projections having rectangular cross-sectional shape with the mould partially in section.
Figure 5:
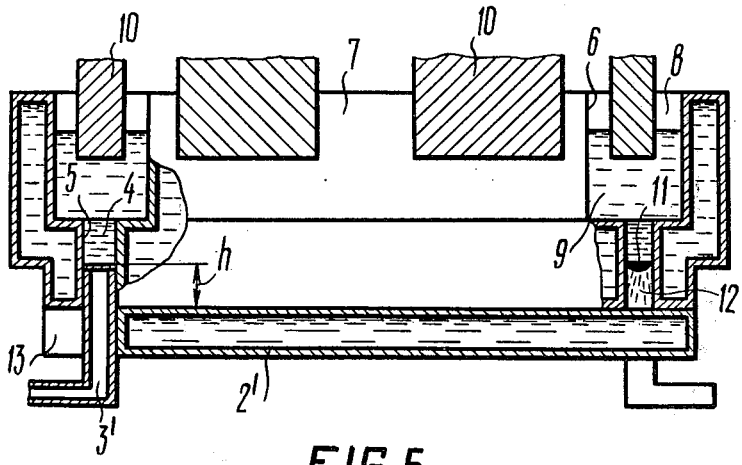
FIG. 5 shows a partial sectional view taken along the line V—V in FIG. 4.

The bottom part of the internal space 4 of the chilled mould 1 has a narrower cross section thn the top part thereof and is intended for maintaining therein a molten metal bath 11 which is formed as a result of melting the consumable electrodes 10 whose metal solidifies into a hollow metal ingot 12 being formed. According to the invention, the apparatus may have, in various embodiments thereof, the bottom plate 2 provided with at least two projections 3 (FIG. 3) and 3′ (FIGS. 4 and 5) uniformly spaced over the working surface thereof and shaped as teeth, the thickness ($n$) (FIG. 1) of each tooth being equal to the amount of space between the surface of the inner wall 5 of the hollow chilled mould 1 and the outer surface of the wall 6 of the mandrel 7 moulding the hollow metal-ingot 12, and the height ($h$) (FIG. 3) and the width ($m$) (FIG. 1) of each projection 3 being commensurable with its thickness ($n$).

The projections 3′ (FIGS. 4 and 5) may be replaceable. For that purpose, the bottom plate 2 is provided with grooves 13 for mounting and fixing therein the projections 3′.

The apparatus may have a bottom plate 2′ of rectangular shape, and the projections 3′ may be arranged thereon symmetrically relative to the longitudinal and transverse axes of the bottom plate.

The apparatus according to the invention functions in the following manner.

The hollow chilled mould 1 (FIG. 1) and the mandrel 7 are mounted on the bottom plate 2 (FIG. 2) in such a manner that the projections 3 are received between the inner wall 5 of the hollow chilled mould 1 and the outer wall 6 of the mandrel 7 with the formation of the internal space 4 for moulding the hollow metal ingot 12. The consumable electrodes 10 are then introduced into the enlarged part 8 of the hollow chilled mould 1. The slag bath 9 is formed in the hollow chilled mould, and the consumable electrodes 10 are then energized. As heat is released in the slag bath 9, the process of electroslag remelting of the consumable electrodes 10 begins. Thus, the hollow chilled mould 1 and the mandrel 7 remain stationary relative to the bottom plate 2. Where the molten metal bath 11 reaches the top end face of the projections 3, the displacement of the hollow chilled mould 1 and the mandrel 7 upwards or of the bottom plate 2 downwards begins at a speed corresponding to the rate of remelting of the hollow metal ingot 12, whereafter the ingot is formed in a conventional manner.

Tests conducted with the apparatus according to the invention have shown that no jamming of the mandrel by the metal ingot occurred during the solidification period at the beginning of the melting cycle.

What is claimed is:

1. An apparatus for melting hollow metal ingots during electroslag remelting of consumable electrodes comprising: a bottom plate; at least two projections uniformly spaced over the working surface of the bottom plate; a hollow chilled mould mounted on the bottom plate and having an inner wall, the surface of the inner wall moulding the outer surface of an ingot being formed; a mandrel having an outer surface for moulding the inner surface of the ingot, the mandrel being introduced into the internal space of the chilled mould; the projections of the bottom plate shaped as teeth, the thickness of each of the teeth being equal to the amount of space between the surface of the inner wall of the hollow chilled mould and the outer surface of the mandrel which moulds the ingot, and the height and the width of each of the projections being commensurable with the thickness thereof.

2. The apparatus according to claim 1, wherein each of the projections has a trapezoidal shape in longitudinal section, the larger side of the trapezium facing the bottom plate.

3. The apparatus according to claim 1, wherein the bottom plate is provided with grooves for mounting and fixing therein the projections which are replaceable.

4. The apparatus according to claim 1, wherein the bottom plate has a rectangular shape and the projections are arranged symmetrically relative to the longitudinal and transverse axes of the bottom plate.

* * * * *